US006849035B2

(12) United States Patent
Duvernay et al.

(10) Patent No.: US 6,849,035 B2
(45) Date of Patent: Feb. 1, 2005

(54) EXERCISE DEVICE FOR LEG EXERCISES

(76) Inventors: Daniel J. Duvernay, 8687 N. River Rd., Marine City, MI (US) 48039; David J. Itrich, 517 N. Main St., Marine City, MI (US) 48039

( * ) Notice: Subject to any disclaimer, the term of this patent is extended or adjusted under 35 U.S.C. 154(b) by 277 days.

(21) Appl. No.: 10/066,020

(22) Filed: Jan. 31, 2002

(65) Prior Publication Data

US 2003/0144115 A1 Jul. 31, 2003

(51) Int. Cl.[7] ..... A63B 69/16
(52) U.S. Cl. ..... 482/60
(58) Field of Search ..... 482/51–53, 60, 482/70, 71, 79, 80, 111–113, 121, 122, 124, 128, 135, 139, 148, 904, 910, 907, 908

(56) References Cited

U.S. PATENT DOCUMENTS 4,705,028 A * 11/1987 Melby ..... 482/51
4,862,875 A * 9/1989 Heaton ..... 601/26
4,946,162 A * 8/1990 Lubie ..... 482/113
4,973,046 A 11/1990 Maxwell

* cited by examiner

*Primary Examiner*—Nicholas D. Lucchesi
*Assistant Examiner*—Tam Nguyen
(74) *Attorney, Agent, or Firm*—Brooks Kushman P.C.

(57) ABSTRACT

An exercise device for leg exercises comprising a pair of foot pedals connected to actuation rods. While an operator is in a seated position, the operator uses their foot to apply pressure to the foot pedals so that the rod telescopes into and out of a bearing block in response to the applied pressure. A crossbar, elevated off ground by a pair of arched base bars, supports the bearing block for the telescoping oscillations.

24 Claims, 4 Drawing Sheets

EXERCISE DEVICE FOR LEG EXERCISES

BACKGROUND OF THE INVENTION

1. Field of the Invention

The present invention relates to exercise devices that can be used for leg exercises while an operator is in a seated position.

2. Background Art

The portion of the human body located approximately between the waistline and feet is characterized as the lower extremity. While a person is seated, this portion of the body tends to receive little if any physical movement. As such, when muscles are not in motion the blood supplied thereto tends to decrease or become stale. In response, muscles can stiffen, atrophy, and the like. As a result blood clots and other maladies can occur. Exercising leg muscles while seated causes blood flow through the lower extremity to increase and the effects of remaining in a seated position for extended periods of time to ameliorate. Accordingly, there exists a need for an exercise device that can be used for leg exercises while an operator is in a seated position to increase blood flow to the lower extremity.

Exercise not only increases blood flow, but resistive exercise can increase muscle mass, strength, and endurance. Accordingly, there exists a need for an exercise device that can not only increase blood flow, but that can also be used for resistive leg exercises while the operator is in a seated position to increase muscle mass, strength, and endurance.

The number of locations where a person is seated and desires to perform leg exercises are numerous, and may include the operator sitting at desks and tables, in passenger seats of planes, trains, boats, wheelchairs, hospital beds, or as a passenger in an automobile. Accordingly, there exists a need for an exercise device that can be used for leg exercises while the operator is seated in these types of locations. Such a device should be adjustable so that it can be easily adjusted to operate in the particular environment. Moreover, such a device should be lightweight and compact for improved transferability and portability between these environments.

As discussed, there are numerous locations where an operator is in a seated position. Most of these positions are in confined areas with limited expanses to position a leg exercising device. The range of motion that the operator has to work within in these environments is limited. Accordingly, there exists a need for a leg exercise device that has a telescoping motion that corresponds to the limited range of leg motion for these confined locations. In addition, there exists a need for the device to include a structure that is compact to fit within these environments. Finally, such a telescoping exercise device should include a simplistic mode of operation having a limited number of components so that it can be easily assembled and manufactured in a cost efficient manner.

As evidenced by the foregoing, there exists a need for a leg exercise device that an operator can use from a seated position. Accordingly, it is an object of the present invention to meet the foregoing needs.

SUMMARY OF THE INVENTION

The present invention provides an exercise device that is used for leg exercises while an operator is in a seated position.

In accordance with one aspect of the present invention, the exercising movement performed by the operator is a telescoping motion where the operator actuates their legs against foot pedals. An actuating rod is connected between the foot pedals and a bearing block. The operator presses their feet against the foot pedals to cause each rod to separately oscillate in a telescoping motion lengthwise into and out of the bearing block. The bearing block includes resistive elements, like rubber bands, springs, or pneumatic or hydraulic cylinders for tunably providing different levels of resistance to the foot pedals.

In accordance with other aspects of the present invention, the device is adaptable and transportable. The range of movement performed by the operator can be adapted to conform to the particular environment of use. For example, an actuation angle of the rods can be adjustable by angularly inclining and declining a bearing block through which the rods extend. Accordingly, the range of operator movement can be adapted to the particular environment of use. Moreover, the actuation angle is selectable to insure that a force centerline of the rods against the bearing block is projected to intersect ground between endpoints of the base bars to help prevent the device from tipping over. Additionally, the bearing block is moveable along the base bars for changing an incident angle of the telescoping rods to limit base slippage. Finally, the telescoping mode of operation is achieved with a limited number of components and within a compact and lightweight structure for improved transferability and portability. The limited number of components and telescoping mode of operation makes the device easy to assemble and cost efficient to manufacture.

Other aspects of the invention include the foot pedals having a strap which wraps around the operators feet and secures each foot to the pedal. The strap includes an adjustable means, like Velcro, to tighten the strap around the operator's foot. The foot pedal includes a swivel bar that connects to an attachment bracket for connecting the foot pedals to the rods and to insure the operator's foot remains perpendicular to the actuation rods during the telescoping oscillations. Other items include the base structure having grippers, like rubber or foam coverings, to increase friction between ends of the base bars and ground to further ameliorate slippage of the base bars.

DETAILED DESCRIPTION OF THE PREFERRED EMBODIMENT(S)

Figure 1:
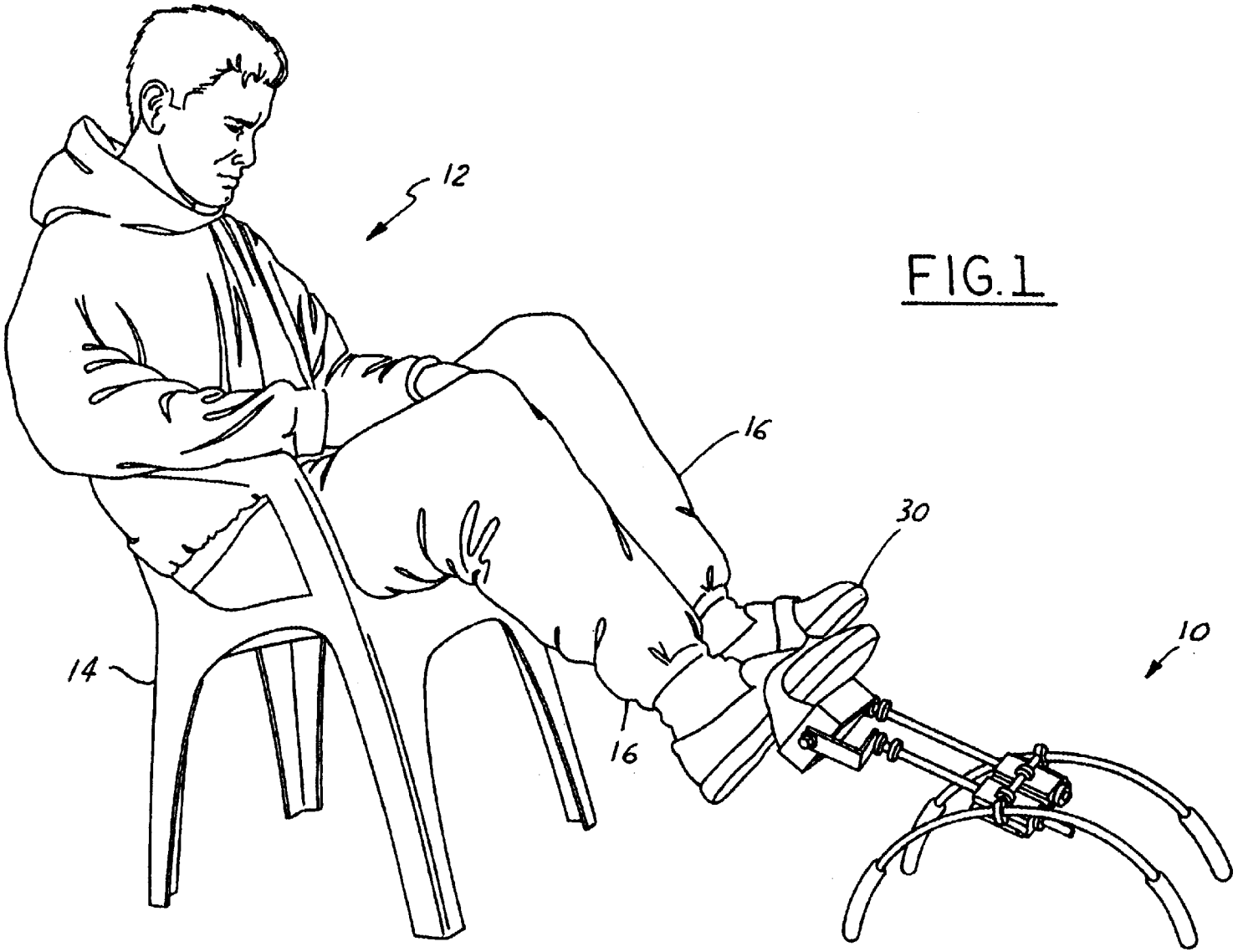
FIG. 1 illustrates one embodiment of the present invention that provides an exercise device that is used for leg exercises while an operator is in a seated position in accordance with the present invention.

FIG. 1 illustrates one embodiment of the present invention that provides an exercise device 10 for leg exercises. As shown, device 10 is operated while an operator 12 is seated in chair 14. From chair 14, operator legs 16 are oscillated in a telescoping manner against exercise device 10.

Chair 14 is just one example of a location in which operator 12 is in a seated position. Device 10 is meant for operation in any type of environment where operator 12 desires to exercise legs 16 from a seated position. Accordingly, other environments include operator 12 sitting at desks and tables, in passenger seats of cars and planes, or in restricted seating arrangements like hospital beds and wheelchairs. The compact size of device 10 provides an exercise device that can be easily transported and adapted to each of these environments. The simplistic telescoping range of motion and adaptability of said motion allows device 10 to function in all of these environments.

Figure 2:
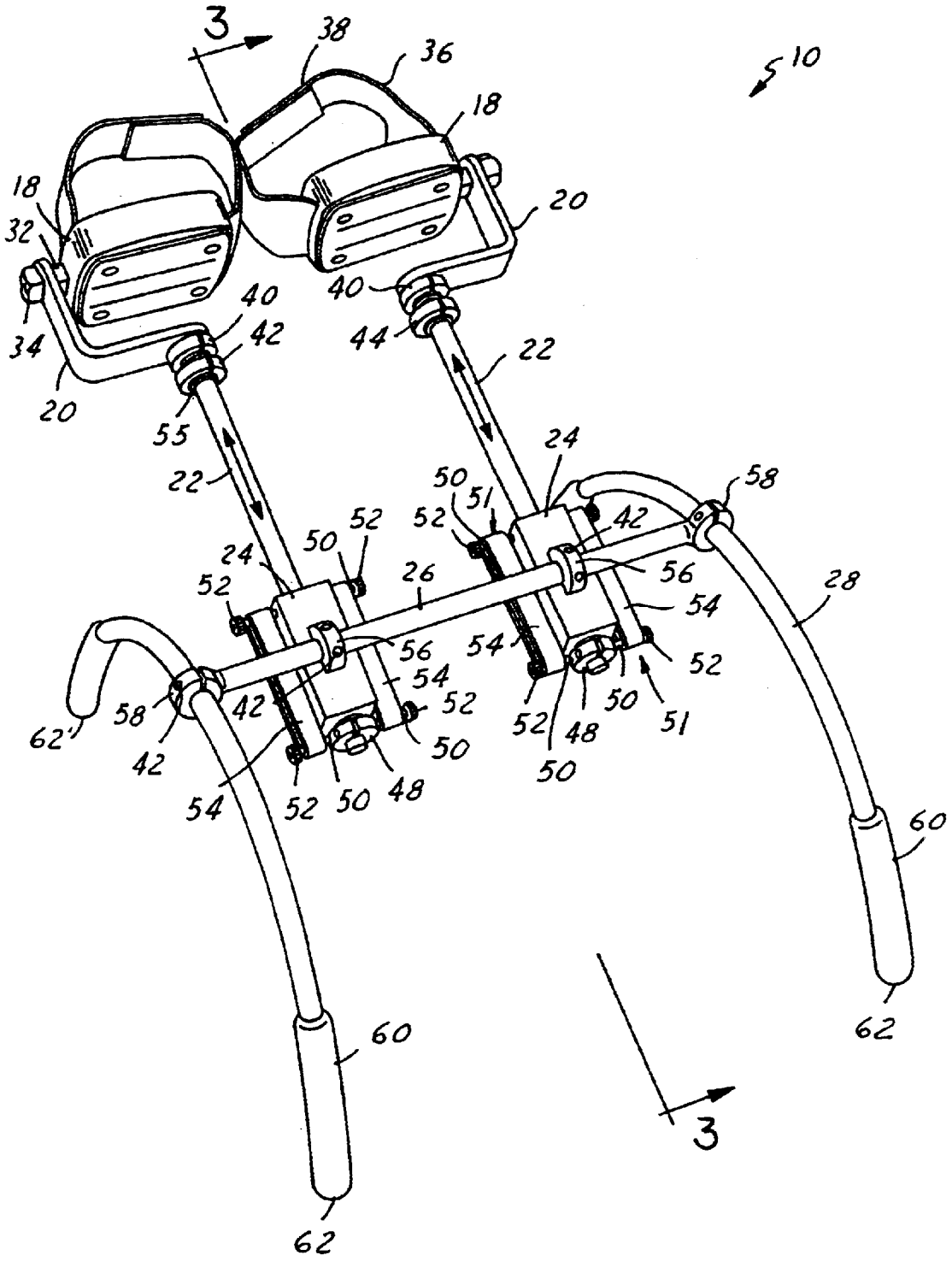
FIG. 2 illustrates an expanded view of the exercise device shown in FIG. 1.

Exercise device 10 is shown with greater detail in FIG. 2. As shown, foot pedals 18 are secured to foot pedal attachment brackets 20. Each attachment bracket 20 is connected to bearing block 24 through a connection with actuation rod 22. Bearing block 24 is secured to crossbar 26 and crossbar 26 is secured to base bars 28. Accordingly, when operator feet 30 are pressed against pedals 18, pedals 18 can cause actuating rods 22 to reciprocate in a direction lengthwise of rod 22 to move in an telescoping manner through bearing block 24. As such, repeatedly telescoping legs 30 in an alternating manner against device 10 causes rods 22 to oscillate into and out of each bearing block 24 for leg exercising.

Pedals 18 are secured to attachment bracket 20 by a swivel bar 32 and fastening nuts 34. Swivel bar 32 is manufactured along with pedal 18, as is known in the art. Swivel bar 32 extends out from the pedal and through bracket 20. Fastening nuts 34 are threadably attach to swivel bar 32 on both sides of bracket 20 to secure pedal 18 thereto. In some cases, swivel bar 32 may already include a nut integral with swivel bar 32 next to pedal 18 for which only one fastener 34 is required to secure pedal 18 to bracket 20.

Swivel bar 32 allows pedal 18 to rotate in response to the angle of foot 30. Accordingly, foot 30 is perpendicular to rod 22 during telescoping oscillation. Pedal 18 also can include a strap 36 that wraps around foot 30 and secures it thereto by fastening means 38, which is shown as Velcro but can be any type of similar fastening means.

Bracket 20 is secured at the one end to pedal 18 and at the other end to rod 22. Integral collar 40 secures bracket 20 to rod 22. Integral collar 40 is typically welded to bracket 20 and compressibly fastened to rod 22. Screws 42 are include within collar 40. When screws 42 are tightened, the halves of collar 40 compress toward each other and around rod 22. Screws 42 are tightened to such a degree that the friction between rod 22 and collar 40 is sufficient to prevent collar 40 from sliding off rod 22.

Figure 3:
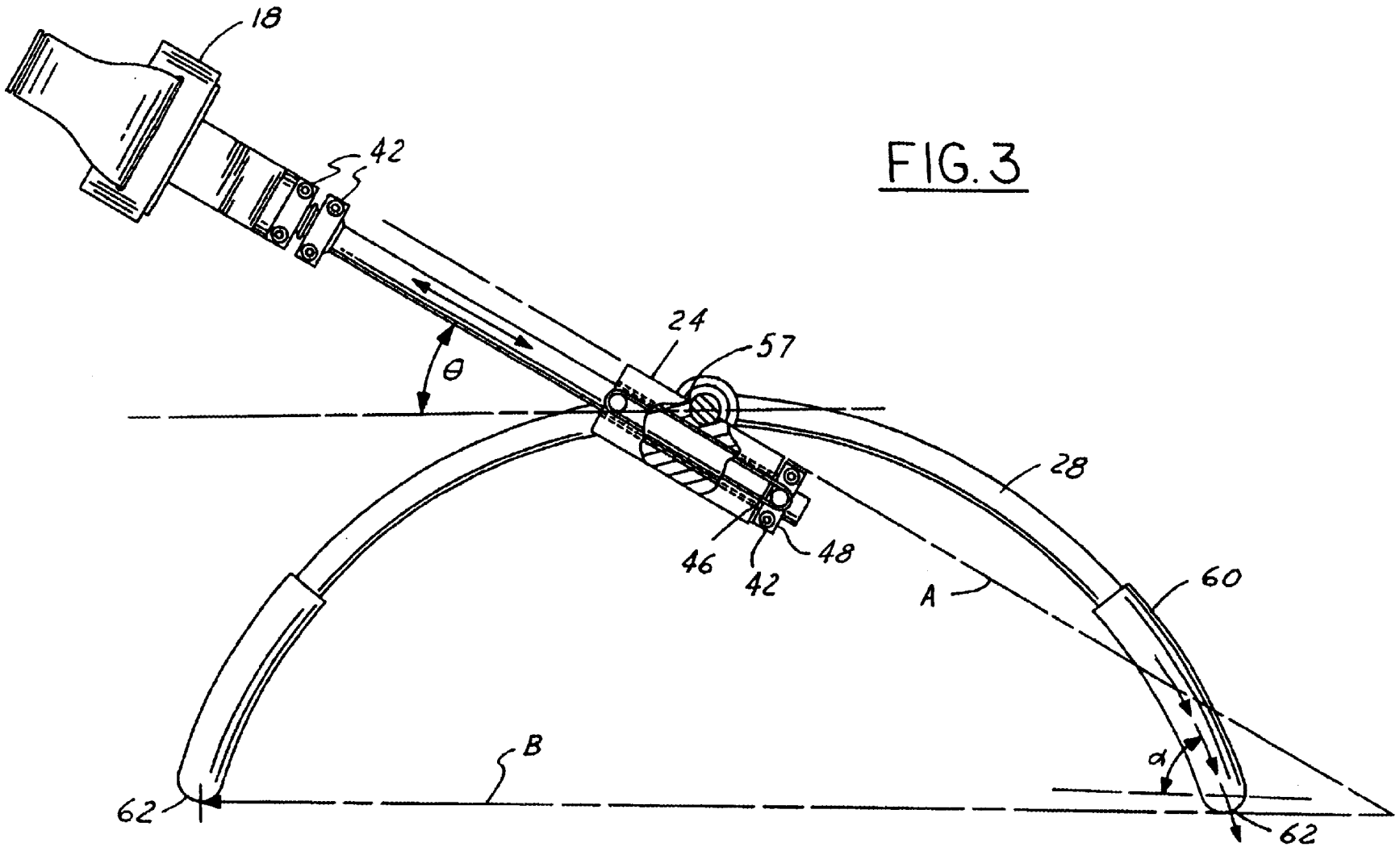
FIG. 3 illustrates a side elevation view of the exercise device shown in FIG. 2.

Referring to FIG. 3, rod 22 passes in one side of bearing block 24 through aperture 46 and out the other side. A fastener collar 48 is secured to the end of rod 22 extending beyond bearing block 24 to secure rod 22 thereto. Collar 48 is compressibly fit to rod 22 by screws 42. Accordingly, rod 22 telescopes lengthwise into and out of bearing block 24 through aperture 46.

Collar 48 includes two diametrically opposed screws 50 having heads 52. Each screw 50 is screwable partially into collar 48 to create a gap 51 between collar 48 and head portion 52. Bearing block 24 also includes two diametrically opposed screws 50 having heads 52, as shown in FIG. 2. Likewise, there is also a gap 51 along screw 50 between bearing block 24 and screw heads 52. Resistive elements 54 are banded within gaps 51 on corresponding screws 50 of bearing block 24 and collar 48. In some case, each gap 51 may include a spacer covering the threads of screw 50.

Resistive element 54 is a rubber band type material. This material is able to expand and retract upon the exertion of pressure and release of said pressure. The resiliency of the rubber material can very with different compositions. By selecting a desired composition the resistance can be tuned by operator 12 to any level of resistance. For example, if operator 12 would like to develop muscle mass, operator 12 would select a resistive element 54 which has a high resistive strength. On the other hand, operator 12 may also increase resistance by banding multiple resistive elements 54 to screws 50. By layering resistive elements 54, resistive strength is increased.

Figure 4:
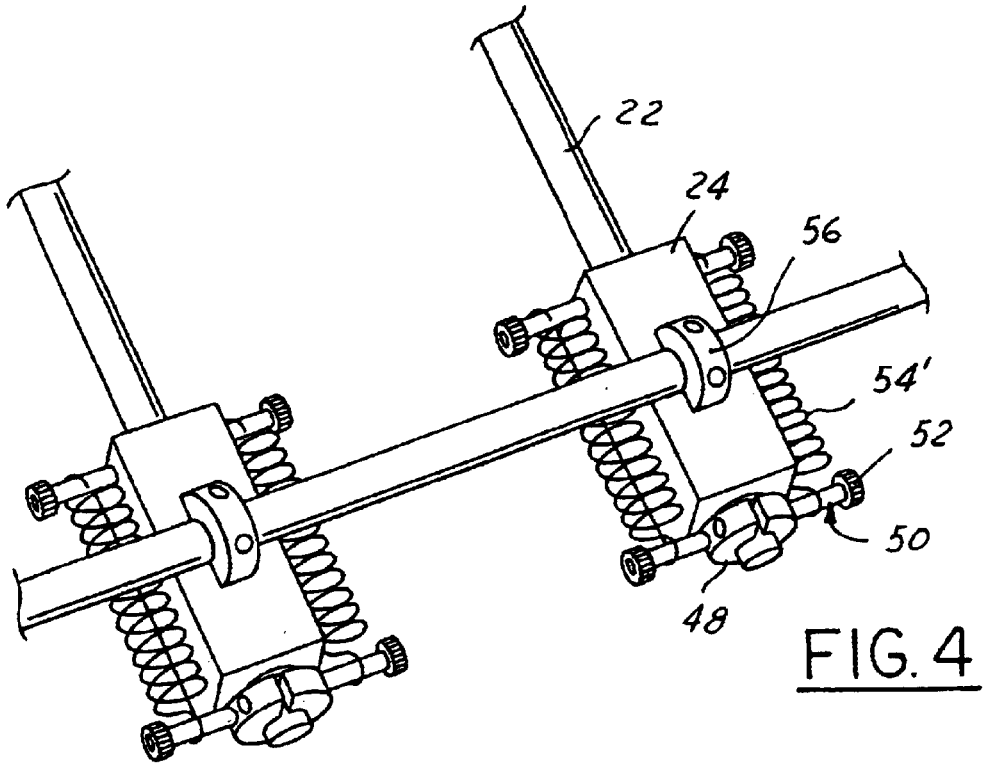
FIG. 4 illustrates one embodiment of the present invention wherein a bearing block includes springs connected between the bearing block and rods in accordance with the present invention.
Figure 5:
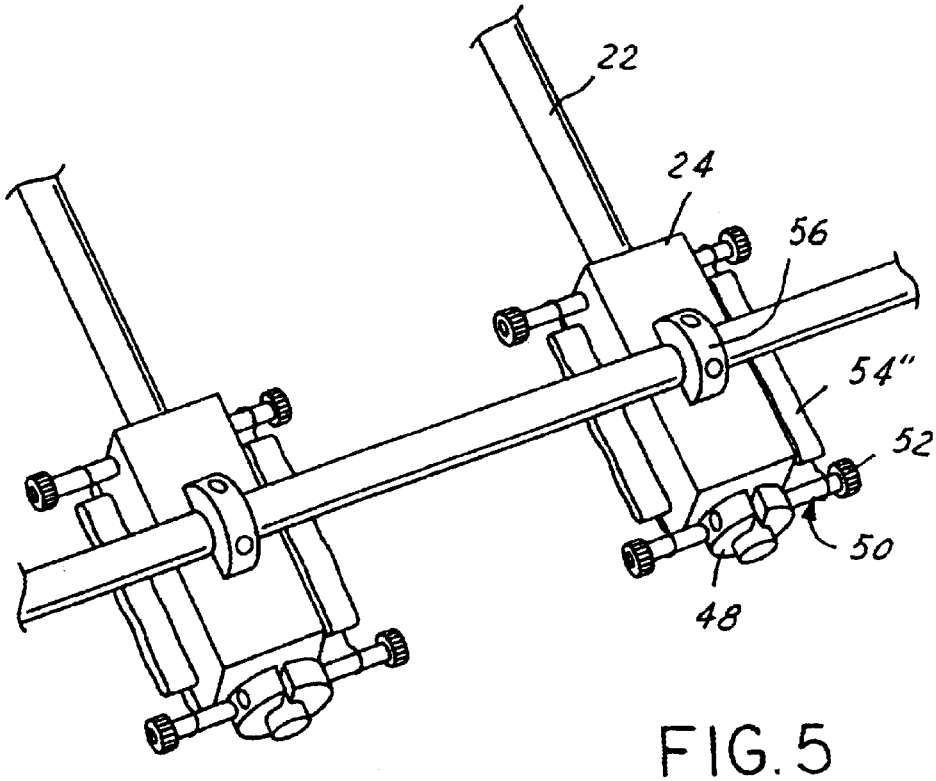
FIG. 5 illustrates one embodiment of the present invention wherein a bearing block includes pneumatic or hydraulic cylinders connected between the bearing block and rods in accordance with the present invention.

In an alternative embodiment shown in FIG. 4, resistive element 54' can also be a spring. Likewise, the resistive strength of the spring depends on its composition and said strength can be tunable by selecting a desired composition or banding multiple springs. FIG. 5 illustrates another embodiment where resistive elements 54" are pneumatic or hydraulic cylinders.

When pressure is provide to pedal 18, and if said pressure is greater than the strength of resistive element 54, pedal 18 forces rod 22 to telescope into bearing block aperture 46 and lengthwise against resistive element 54. When said pressure is released, resistive element 54 contracts and forces rod 22 back to its original position.

A slidable collar 44 is also secured between integral collar 40 and bearing block 24 along rod 22. Collar 44 provides a stop that prevents pedal 18 from reaching bearing block 24. Collar 44 is compressibly fitted around rod 22 by screws 42. Collar 44 can be located along any portion of rod 22 between collar 40 and bearing block 24. Collar 44 acts as a stop so that the stroke of rod 22 can be adjusted based on the position of slidable collar 44. The closer collar 44 is to bearing block 24, the shorter the stroke and the farther collar 44 is from bearing block 24, the longer the stoke.

Accordingly, with collar 44 on one side of bearing block 24 and collar 48 on the other side, the telescoping action of rod 22 is achieved. In this manner, pedal 18 telescopes toward bearing block 24 until collar 44 contacts bearing block 24. When collar 44 is in contact with bearing block 24, pedal 18 is depressed to its maximum stroke length. After telescoping to its maximum stroke length, resistive element 54 can causes pedal 18 to retract back until collar 48 contacts the other side of bearing block 24.

Rubber rings 55 are sometimes included along rod 22 to cushion contact areas. For example, rings 55 are beneficial in between collar 44 and bearing block 24 to prevent metal on metal contact between collar 44 and bearing block 24. Similarly, a ring 55 may also be included between bearing block 24 and collar 48.

Bearing block 24 is secured to crossbar 26 by bearing block collars 56. Collar 56 includes screws 42 extending through collar 56, around crossbar 26, and into bearing block 24. To facilitate this securement, bearing block 24 may include an arched cut-out or semi-circular recess 57 corresponding to the curvature of crossbar 26 and collar 56. This allows bearing block 24 to form the other half of collar 56 for maximum compression and fitting to crossbar 26.

The position of bearing blocks 24 can be anywhere along crossbar 26. Operator 12 can change the spacing of pedals 18 for different types of exercises and movements. Once in positions, screws 42 are tightened to secure the location of bearing block 24 along crossbar 26.

Bearing blocks 24 can be arranged at specific actuation angles θ. Actuation angle θ is adjusted to control a range of motion of legs 16 by angularly inclining or declining bearing block 24 around crossbar 26. Such functionality is beneficial for those environments where the range of motion may be limited, like when exercise device 10 is located under a desk and table, or being operated from passenger seats in cars and planes. Moreover, by adjusting the range of motion operator 12 can work leg muscles at different angles for variable exercises. Once at the desired actuation angle θ, collar 56 is simply tightened into position.

Each end of crossbar 26 includes an integral end collar 58. End collar 58 is secured to base bar 28 by compression forces generated from tightening screws 42. Base bars 28 are configured into an arched frame so that crossbar 26 can be elevated off ground. This allows rods 22 to extend down through bearing block 24 and toward ground but not into contact with ground.

Crossbar 26 can be positioned along arched base bars 28 in any desired location by simply tightening screws 42. Accordingly, an incident angle α of forces transmitted through base bars 28, by the actuation of rod 22, can be selected. In this manner, the forces applied to pedals 18 transfer through base bars 28 and generate the greatest amount of friction between base bars 28 and ground to limit slippage. For example, when incident angle α is low, then base bars 28 have a greater tendency to slip but when incident angle α approaches 90° base bars 28 have less of a tendency to slip.

The interaction of actuation angle θ with incident angle α can be manipulated to limit slippage. For example, if actuation angle θ is low, then crossbar 26 is positioned closer to the top of arched base bars 28 so that incident angle α increases and the forces communicated to base bars 28 are transmitted into ground at the greatest angle of inclination, ideally 90°. Adjusting actuation angle θ inconjunction with incident angle α allows the range of operator motion to be adjusted as need while at the same time limiting slippage.

The interaction of actuation angle θ with incident angle α is also used to control tipping. Device 10 can tip forward if force centerline A projects to intersect line B beyond endpoint 62. For example, centerline A shown if FIG. 3 illustrates a case where force centerline A projects to intersect line B beyond endpoint 62. Accordingly, device 10 could tip forward if the pressure applied to pedals 18 was sufficient and base bars 28 did not slip. To limit such tipping, force centerline A would ideally project to intersect line B between the endpoints 62 and 62' of base bars 28.

In addition to selecting an appropriate incident angle α, grippers 60 can be attached to base bar 28 to further enhance friction between base bars 28 and ground to ameliorate slippage. For example, grippers 60 may include rubber or foam materials which have a greater coefficient of friction than the material of base bars 28.

The materials of all components maybe selectable depending on the type of product. For example, to decrease costs and weight, it is possible to produce most, if not all, of the components from plastics. However, if greater forces and stress are applied to the device, then it may be beneficial to produce most, if not all, of the components out of metals.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An exercise device for leg exercises, the device comprising:

a pair of foot pedals;

a pair of actuating rods connected to the foot pedals;

a bearing block having an aperture, the rods telescoping through the aperture at a selectable actuation angle in response to pressure applied to the foot pedals;

a crossbar extending between arched base bars upon which the bearing block is secured; and at least one resistive element attached between the rod and bearing block to provide resistance to pressure applied to the foot pedals.

2. The device of claim 1, wherein the selectable actuation angle is selected at an angle that causes a force centerline of the rods to be projected between endpoints of the arched base bars to limit tipping.

3. The device of claim 1, wherein a position of the crossbar along an arch of the base bars is based on an interaction of crossbar position and actuation angle to provide a maximum incident angle of the base bars to ground.

4. The device of claim 1, wherein the resistive element is a rubber band.

5. The device of claim 1, wherein the resistive element is a spring.

6. The device of claim 1, wherein the resistive element is a pneumatic cylinder.

7. The device of claim 1, wherein the resistive element is a hydraulic cylinder.

8. The device of claim 1, further comprising an attachment bracket securing to a swivel bar of the foot pedals to connect the foot pedals to the actuating rods.

9. The device of claim 1, wherein the rods include a fastener for limiting a stroke of the actuating rods.

10. The device of claim 1, wherein the foot pedals include a strap for securing the pedals to feet of an operator.

11. The device of claim 1, wherein the bearing block is attached to the crossbar by a fastener that is adjusted to space apart the bearing block and to select the actuation angle.

12. The device of claim 11, wherein the crossbar includes end fasteners for position the crossbar along the arched base bar so that an incident angle can be controlled to limit slippage.

13. The device of claim 12, further comprising grippers at each end of the base bars to limit slippage.

14. The device of claim 13, wherein the grippers are rubber.

15. The device of claim 1, wherein the base bars only contact ground at endpoints of the based bars.

16. An exercise device for operation only from a seated position, the device comprising:

a pair of base bars constructed like an arch and spaced apart from each other by a crossbar, only each ends of the base bars contact ground;

at least one bearing block secured to the crossbar by a fastening collar, the bearing block being locatable along the crossbar and rotatable around the crossbar for selecting a desired spacing and actuation angle of the bearing block; and a banded resistive element connect to the bearing block for providing resistance to a telescoping of a rod into and out of an aperture of the bearing block in response to a user depressing a foot pedal connected to the rod from a seated position.

17. The device of claim 16, wherein a position of the crossbar along the base bars is based on an interaction of crossbar position and actuation angle to provide a maximum incident angle of the base bars to ground to limit slippage and to insure a force centerline of the rods projects between endpoints of the base bars to limit tipping.

18. A device for exercising the legs while in a seated position comprising, in combination:

a frame for resting on the floor in front of a person in a seated position;

a pair of foot pedals;

a pair of actuating rods with one pedal mounted on the end of each rod such that each pedal is only mounted to the end of one of the actuating rods;

a bearing block carried by the frame and supporting each rod for reciprocating movement in a direction lengthwise of the rod when a person in a seated position pushes with their feet against said pedals; and a resistive element connected between each rod and its bearing block to provide resistance to foot pressure applied to the pedals tending to shift the rod lengthwise against the resistance of the resistive element.

19. The device of claim 18, wherein the bearing block includes an aperture, the rods telescoping through the aperture at a selectable actuation angle in response to the foot pressure applied to the pedals.

20. The device of claim 19, wherein the actuation angle is selected so that a force centerline intersects ground between end points of the frame.

21. The device of claim 20, wherein the resistive element is a rubber band.

22. The device of claim 18, wherein the resistive element is a spring.

23. The device of claim 18, wherein the resistive element is a pneumatic cylinder.

24. The device of claim 18, wherein the resistive element is a hydraulic cylinder.

* * * * *

UNITED STATES PATENT AND TRADEMARK OFFICE

CERTIFICATE OF CORRECTION

PATENT NO. : 6,849,035 B2
DATED : February 1, 2005
INVENTOR(S) : Daniel J. Duvernay and David J. Itrich It is certified that error appears in the above-identified patent and that said Letters Patent is hereby corrected as shown below:

Column 6,
Line 42, delete “position” and insert -- positioning --.
Line 61, delete “connect” and insert -- connected --.

Signed and Sealed this

Tenth Day of May, 2005

JON W. DUDAS
*Director of the United States Patent and Trademark Office*